US008485649B2

(12) United States Patent
Nakamura

(10) Patent No.: US 8,485,649 B2
(45) **Date of Patent: *Jul. 16, 2013**

(54) LIQUID JETTING APPARATUS

(75) Inventor: Hirotake Nakamura, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 718 days.

This patent is subject to a terminal disclaimer.

(21) Appl. No.: 12/625,814

(22) Filed: Nov. 25, 2009

(65) Prior Publication Data

US 2010/0128092 A1 May 27, 2010

(30) Foreign Application Priority Data

Nov. 26, 2008 (JP) ..... 2008-300511

(51) Int. Cl.
*B41J 2/175* (2006.01)
*B41J 2/17* (2006.01)

(52) U.S. Cl.
USPC ..... 347/85; 347/84

(58) Field of Classification Search
USPC ..... 347/84, 85
See application file for complete search history.

(56) References Cited

U.S. PATENT DOCUMENTS 8,226,220 B2 * 7/2012 Nukui ..... 347/85
2005/0195252 A1 * 9/2005 Ishikawa et al. ..... 347/84

FOREIGN PATENT DOCUMENTS

JP 2003211691 7/2003

* cited by examiner

*Primary Examiner* — Jannelle M Lebron
(74) *Attorney, Agent, or Firm* — Frommer Lawrence & Haug LLP

(57) ABSTRACT

A liquid jetting apparatus includes a liquid jetting head which reciprocates in a first direction on a predetermined plane and which jets the liquid from a nozzle; a liquid supply source which stores the liquid to be supplied to the liquid jetting head; a flexible tube which is fixed to the liquid jetting apparatus at a predetermined fixed portion different from a connecting portion of the tube at which the tube is connected to the liquid jetting head, and which is arranged in a state that the tube is bent at a portion between the fixed portion and the connecting portion; and a regulating member which is arranged to regulate a movement of the tube caused by the bending of the tube, and the regulating member has an accommodating portion which extends in the first direction and accommodates the tube.

17 Claims, 8 Drawing Sheets

LIQUID JETTING APPARATUS

CROSS REFERENCE TO RELATED APPLICATION

The present application claims priority from Japanese Patent Application No. 2008-300511, filed on Nov. 26, 2008, the disclosure of which is incorporated herein by reference in its entirety.

BACKGROUND OF THE INVENTION

1. Field of the Invention

The present invention relates to a liquid jetting apparatus which jets a liquid from nozzles.

2. Description of the Related Art

As an example of a liquid jetting apparatus which jets a liquid from nozzles, in an ink-jet printer described in Japanese Patent Application Laid-open No. 2003-211691, an ink-jet head mounted on a carriage which reciprocates in a main scanning direction and a main tank are connected by a plurality of tubes. The tubes are arranged in a state of being bent so that the tubes are able to follow a movement of the ink-jet head when the ink-jet head reciprocates together with the carriage.

Moreover, in this ink-jet printer, a front frame which forms a wall on a main-tank side with respect to a frontward and rearward direction which is orthogonal to the main scanning direction and parallel to a horizontal plane faces a portion of the tube which extends from the main tank toward the ink-jet head. Reaction forces, which intend to restore the tubes from the bent state to the original state, are generated in bent tubes. However, the tubes make contact with the front frame, and the tubes are prevented from being spread in the horizontal plane due to the reaction forces.

Further, a recess is formed in the front frame at a portion facing the tubes, and the tubes are positioned inside the recess. Moreover, positions in the vertical direction of the tubes are regulated in a state that the tubes are fitted in the recess.

Here, in the ink-jet printer described in Japanese Patent Application Laid-open No. 2003-211691, an ink jet head which jets an ink from nozzles moves, and as it comes closer to a position away from a fixed portion of the tube in the main scanning direction (inner right position in FIG. 1 of Japanese Patent Application Laid-open Publication No. 2003-211691), the tubes make contact with the front frame over a long distance. As a result, the tubes are bent strongly, and a diameter of bending of each of the tubes decreases. When the diameter of bending of each of the tubes decreases, a magnitude of the reaction force increases. At this time, when a size of the recess in the vertical direction (a distance of side surfaces of the recess in the vertical direction) is small, the tubes are not capable of moving vertically inside the recess, and substantial reaction forces are generated in the tubes. Moreover, if such substantial reaction forces are generated in the tubes, when the ink-jet head moves in the main scanning direction, the tubes are caught in the side surface of the recess, and a smooth movement of the ink-jet head is hindered.

SUMMARY OF THE INVENTION

An object of the present invention is to provide a liquid jetting apparatus which is capable of reducing a stress generated in a tube which connects a liquid jetting head and a liquid supply source.

According to a first aspect of the present invention, there is provided a liquid jetting apparatus which jets a liquid, including: a liquid jetting head which reciprocates in a first direction on a predetermined plane and which jets the liquid from a nozzle; a liquid supply source which stores the liquid to be supplied to the liquid jetting head; a flexible tube which construct a part of a liquid flow passage from the liquid supply source to the liquid jetting head, and which is fixed to the liquid jetting apparatus at a predetermined fixed portion which is different from a connecting portion of the tube at which the tube is connected to the liquid jetting head, and which is arranged in a state that the tube is bent at a portion between the fixed portion and the connecting portion; and a regulating member which is arranged to regulate a movement of the tube caused by the bending of the tube, and which has an accommodating portion extending in the first direction and accommodating the tube, and the accommodating portion has a first end portion at which the fixed portion of the tube is accommodated and a second end portion which is opposite to the first end portion in the first direction; and at a portion of the accommodating portion in the vicinity of the second end portion, a width of the accommodating portion, in a second direction orthogonal to the predetermined plane, is increased toward the second end portion in the first direction.

As the liquid jetting head moves farther from the fixed portion with respect to the first direction, a deformation of the tube is regulated for a long distance by the regulating member, a diameter of the bent portion of the tube decreases, and a reaction force that intends to restore the tube from the bent state to the original increases. Therefore, when a distance between the ribs is small, the tube is not capable of moving sufficiently between the ribs, and there is a possibility that a substantial stress is generated in the tube. Moreover, when the substantial stress is generated in the tube, the tube may be caught in the rib. Accordingly, the tube does not follow smoothly the movement of the liquid jetting head, and a smooth movement of the liquid jetting head may be hindered.

However, according to the present invention, at a portion of the accommodating portion in the vicinity of the second end portion which is opposite to the first end portion, width in a second direction of the accommodating portion increases toward the second end portion. Therefore, even in such a case, the tube is capable of moving comparatively freely between the ribs in the second direction, and it is possible to reduce the abovementioned stress generated in the tube.

On the other hand, as the liquid jetting head moves nearer to the fixed portion with respect to the first direction, the diameter of bending of the tube increases, and the reaction force generated in the tube decreases. Therefore, by decreasing the width of the accommodating portion in a direction closer to the first end portion with respect to the first direction, it is possible to suppress the movement of the tube between the ribs, and to prevent effectively the floating of the tube.

BRIEF DESCRIPTION OF THE DRAWINGS

FIG. 2 is viewed from a direction of an arrow V;

DETAILED DESCRIPTION OF THE PREFERRED EMBODIMENTS

Figure 1:
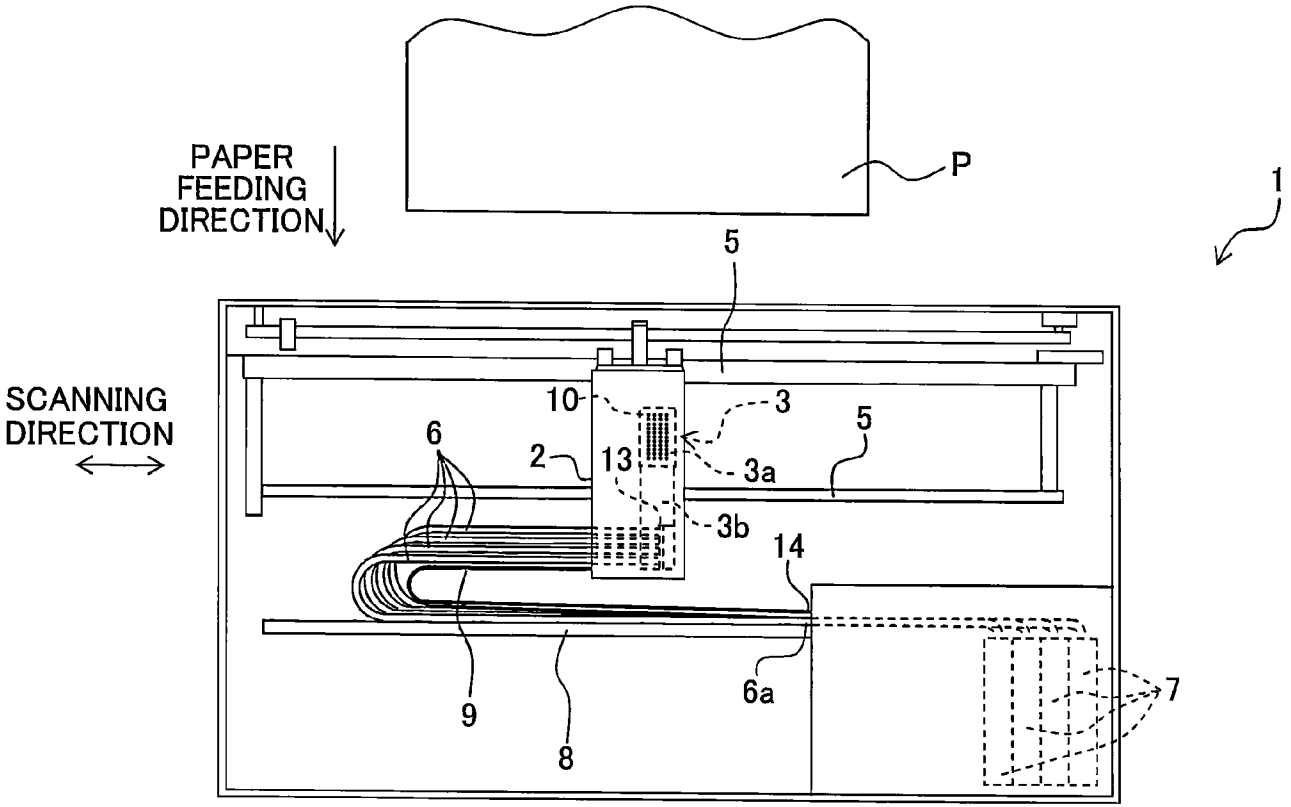
FIG. 1 is a schematic structural view of a printer according an embodiment of the present invention.
Figure 2:
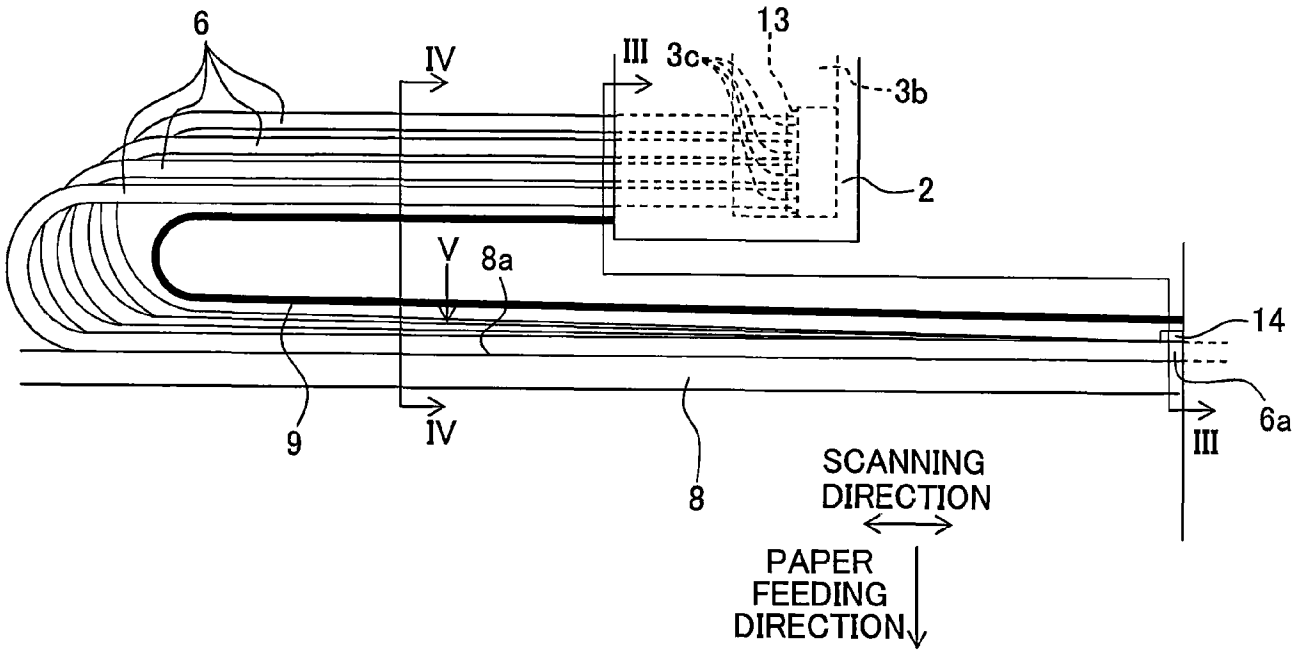
FIG. 2 is a partially enlarged view of an area near a tube in FIG. 1.
Figure 3:
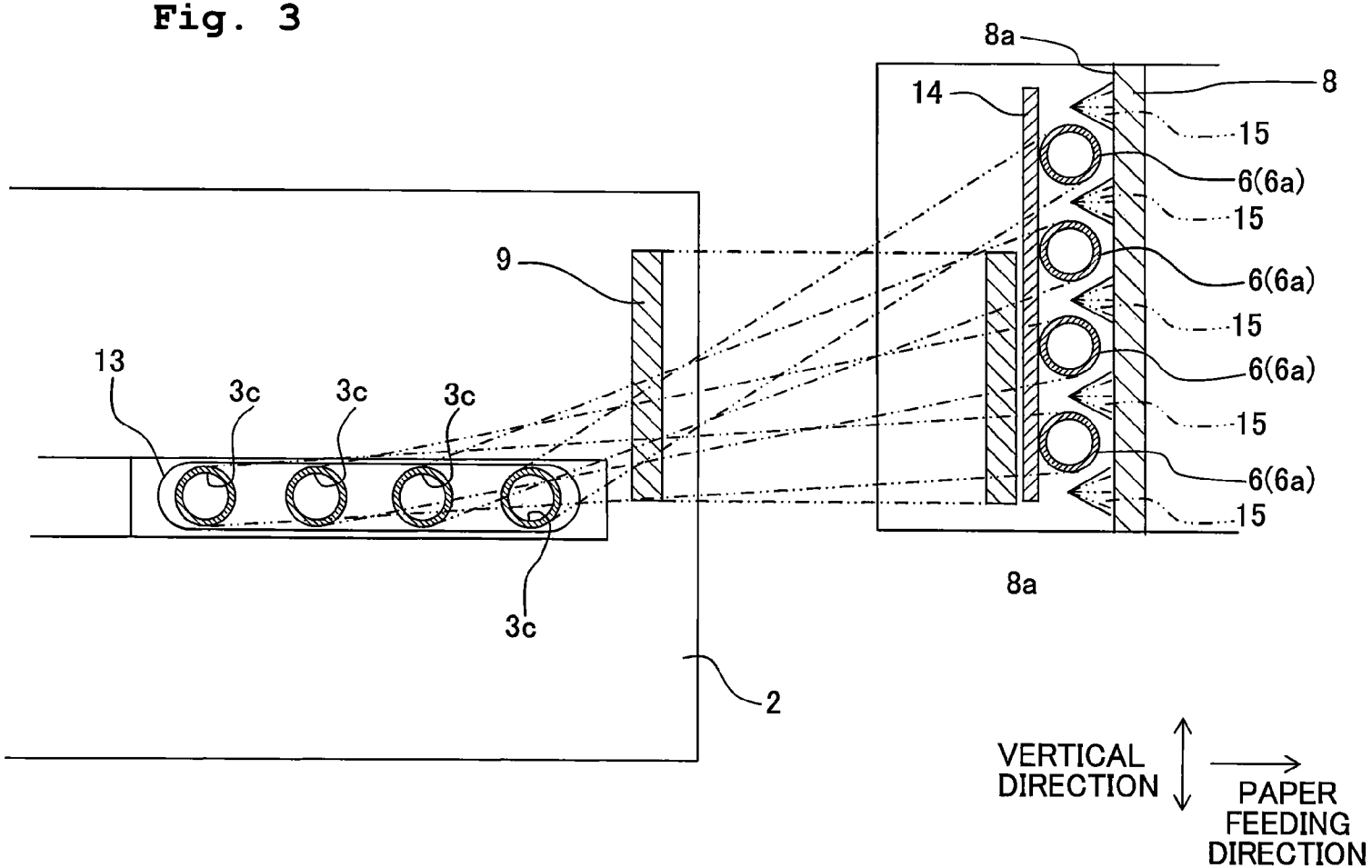
FIG. 3 is a cross-sectional view taken along a line in FIG. 2.

Exemplary embodiments of the present invention will be described below.

As shown in FIG. 1 to FIG. 5, a printer 1 (corresponding to a liquid jetting apparatus of claims) includes a carriage 2, an ink-jet head 3 (corresponding to a liquid jetting head of claims), four tubes 6, four ink cartridges 7, a tube guide 8, and a flexible flat cable (FFC) 9.

The carriage 2 reciprocates in a scanning direction (a left-right direction in FIG. 1, a first direction) which is parallel to a horizontal plane (corresponding to a predetermined plane of claims) along two guide shafts 5 arranged to be mutually parallel. The ink-jet head 3 has a head main body 3*a* and a sub-tank unit 3*b*. The head main body 3*a* is arranged on a lower surface of the carriage 2, and jets an ink from nozzles 10 which are formed on a lower surface thereof.

A sub tank not shown in the diagram, which stores temporarily the ink to be supplied to the head main body 3*a*, and ink channels not shown in the diagram, which are connected to the sub tank are formed in the sub-tank unit 3*b*. The sub-tank unit 3*b* is connected to the head main body 3*a*, and extends downward in FIG. 1 from a portion connected to the head main body 3*a*. Moreover, four connecting ports 3*c* which are arranged in a row along a paper feeding direction (an upward-downward direction in FIG. 1, a direction parallel to a horizontal plane and orthogonal to a first direction), are provided to the sub-tank unit 3*b*, at a lower end portion thereof in FIG. 1. One ends of the tubes 6 are connected to four connecting ports 3*c* respectively, and accordingly, the ink to be jetted from the nozzles 10 is supplied from the tubes 6 to the ink-jet head 3 as it will be described later.

The four ink cartridges 7 (corresponding to a liquid supply source of claims) are arranged at a right lower-end portion of the printer 1 in FIG. 1, and are arranged in a row in the scanning direction. Inks of colors namely black, yellow, cyan, and magenta are stored in the four ink cartridges 7 respectively, and the other ends of the tubes 6 are connected to the four ink cartridges 7 respectively. Accordingly, the inks stored in the ink cartridges 7 are supplied to the ink-jet head 3 via the tubes 6.

Moreover, in the printer 1, it is possible to carry out printing on a recording paper P by jetting the ink from the nozzles 10 of the ink-jet head 3 which is moving in the scanning direction together with the carriage 2 onto the recording paper P which is transported in the paper feeding direction by a paper transporting mechanism not shown in the diagram.

The four tubes 6 are made of a flexible material such as a synthetic resin, and a cross-section of each of the tubes 6 in a direction orthogonal to an extending direction of each of the tubes 6 is substantially circular shape. Moreover, the four tubes 6 have almost same thicknesses, respectively.

As it has already been described, one ends of the tubes 6 are connected to the connecting ports 3*c* of the ink-jet head 3 respectively, and the tubes 6 extend leftward in FIG. 1, from the connecting ports 3*c*. Moreover, the tubes 6 are curved by about 180° and extend in the rightward direction in FIG. 1, and the other ends of the tubes 6 are connected to the ink cartridges 7 respectively, as it has already been described. In other words, the tubes 6 are extending from fixed portions 6*a* in the scanning direction, bent back in a U-shape at intermediate portions thereof, and connected to the connecting ports 3*c* of the ink-jet head 3. The reason, why the tubes 6 are arranged while being bent in such manner, is that it is intended to allow the tubes 6 to follow the carriage 2 when the carriage 2 is moved in the scanning direction.

Moreover, the tubes 6 are arranged in line in the vertical direction (second direction) at fixed portions 6*a* which are intermediate portions between the bent portions and the ink cartridges 7 (portions different from portions connected to the connecting port 3*c*), and are fixed while being interposed between a fixing member 14 and the tube guide 8.

In this arrangement, all of the fixed portions 6*a* of the tubes 6 are disposed under or below the connecting ports 3*c* of the ink-jet head 3 as viewed in FIG. 1 (positions of the fixed portions 6*a* in relation to a direction, which is along the predetermined plane and perpendicular to the first direction, are different from those of the connecting ports 3*c*). The fixed portions 6*a* are positioned over or above the connecting ports 3*c* of the ink-jet head 3 in relation to the vertical direction. In other words, the connecting ports 3*c* of the ink-jet head 3 are arranged under or below the fixed portion 6*a* which is positioned on the lowermost side and which is included in the fixed portions 6*a* of the four tubes 6. Alternatively, the connecting ports 3*c* of the ink-jet head 3 may be arranged at the same height as that of the fixed portion 6*a* which is positioned at the lowermost position.

The four tubes 6 are fixed in a state of being mutually bundled by a connecting member 13 at the first ends thereof which are connected to the connecting ports 3*c* of the ink-jet head 3. Accordingly, the four tubes 6 can be connected to the connecting ports 3*c* at once by the connecting member 13. The tubes 6 can be easily connected to the connecting ports 3*c*. The four tubes 6 are not mutually bundled at the portions disposed between the one ends thereof and the fixed portions 6*a*, and they are deformable independently.

Further, the tube 6, which is included in the four tubes 6 and which is positioned more upwardly at the fixed portion 6*a*, is connected to the connecting port 3*c* which is positioned on the inner circumferential side (lower side as viewed in FIG. 1) of the bending of the tube 6 as viewed in a plan view, i.e., the connecting port 3*c* which is nearest to the fixed portion 6*a* in relation to the paper feeding direction (upward-downward direction as viewed in FIG. 1). On the other hand, the lengths of the four tubes 6 are approximately identical with each other in order that the flow passage resistances of the inks are uniformized. Therefore, as shown in FIGS. 1 to 4, the four tubes 6 are arranged so that the tube 6, which is positioned more downwardly, has the portion which is disposed between the first end of the tube 6 and the fixed portion 6*a* and which is positioned on the outer circumferential side of the bending of the tube 6 as viewed in a plan view. In this manner, the four tubes 6 are connected to the connecting ports 3*c* of the ink-jet head 3 and are fixed at the fixed portion 6*a* in the twisted state.

In the embodiment, as it has been described above, since the four tubes 6 are mutually separated at the portions between the connecting ports 3*c* and the fixed portions 6*a*, and are capable of being deformed independently, even when the four tubes 6 have the same lengths, it is possible to arrange the tubes 6 in the twisted state so that the tube 6, which has the fixed portion 6*a* positioned more upwardly, is connected to the connecting port 3*c* which is positioned on the inner circumferential side of the bending of the tube 6 as viewed in a plan view, i.e., on the downstream side in the paper feeding direction.

Here, unlike the embodiment, if the connecting ports 3*c* of the ink-jet head 3 are disposed in the vertical direction in conformity with the arrangement of the fixed portions 6*a*, the tubes 6 can be connected to the connecting ports 3*c* without allowing the tubes 6 to be in the twisted state as mentioned above. However, in this case, the length of the ink-jet head 3 (the sub-tank unit 3*b*) in the vertical direction is increased.

In the embodiment, the connecting ports 3*c* of the ink-jet head 3 are disposed in the paper feeding direction. Therefore, it is necessary that the tubes 6 should be in the twisted state as described above in order that the tubes 6, which are arranged in the vertical direction at the fixed portions 6*a*, are connected to the connecting ports 3*c* which are arranged in the paper feeding direction. However, it is possible to decrease the length of the ink-jet bead 3 in relation to the vertical direction.

The tube guide 8 (corresponding to regulating member of claims) is made of a material such as a synthetic resin material, and is arranged to be adjacent to a lower side of the tubes 6 (on a side of outer circumference of the bent tubes 6 in a plan view) in FIG. 1. A surface thereof at an upper side in FIG. 1 is a facing surface 8*a* which extends in the scanning direction and the vertical direction. Portions arranged in the vertical direction of the tubes 6, between the bent portions and the fixed portions (portions directed from the fixed portions 6*a* toward connecting portions with the ink-jet head 3), face and contact with the facing surface 8*a*. Accordingly, the tubes 6 are regulated for the spread which would be otherwise caused such that the portions of the tubes 6 facing the facing surface 8*a* are moved downward in FIG. 1 by the reaction forces F1 to F4 generated by the bending of the tubes 6 as described later on.

Five ribs 15 are formed on the facing surface 8*a* of the tube guide 8. Each of the five ribs 15 projects from the facing surface 8*a*, and has a tapered form in which a width in the vertical direction thereof is decreased in a direction away from the facing surface 8*a*. The five ribs 15 are arranged at a position above one of the tubes 6 which is positioned at the uppermost position, at positions between the four tubes 6, and at a position under another one of the tubes 6 which is positioned at the lowermost position, and arranged to sandwich the four tubes 6 individually, in the vertical direction. In this manner, four accommodating portions in which the four tubes 6 are accommodated respectively are formed in the tube guide 8 by the facing surface 8*a* and the five ribs 15 which project form the facing surface 8*a*.

In the embodiment, out of the five ribs 15, the two ribs 15 which are arranged to be adjacent to each other in the vertical direction and to sandwich one of the tubes 6 therebetween correspond to a pair of ribs according to the present invention. Moreover, out of the five ribs 15, the three ribs, which are arranged between the four tubes 6 and are different from the two ribs 15 arranged at the upper and lower end serve as one of the two ribs forming the pair of ribs sandwiching one of the tubes 6 positioned above these ribs 15, and as one of the ribs forming the pair of ribs sandwiching another one of the tubes 6 positioned below these ribs 15.

Figure 5:
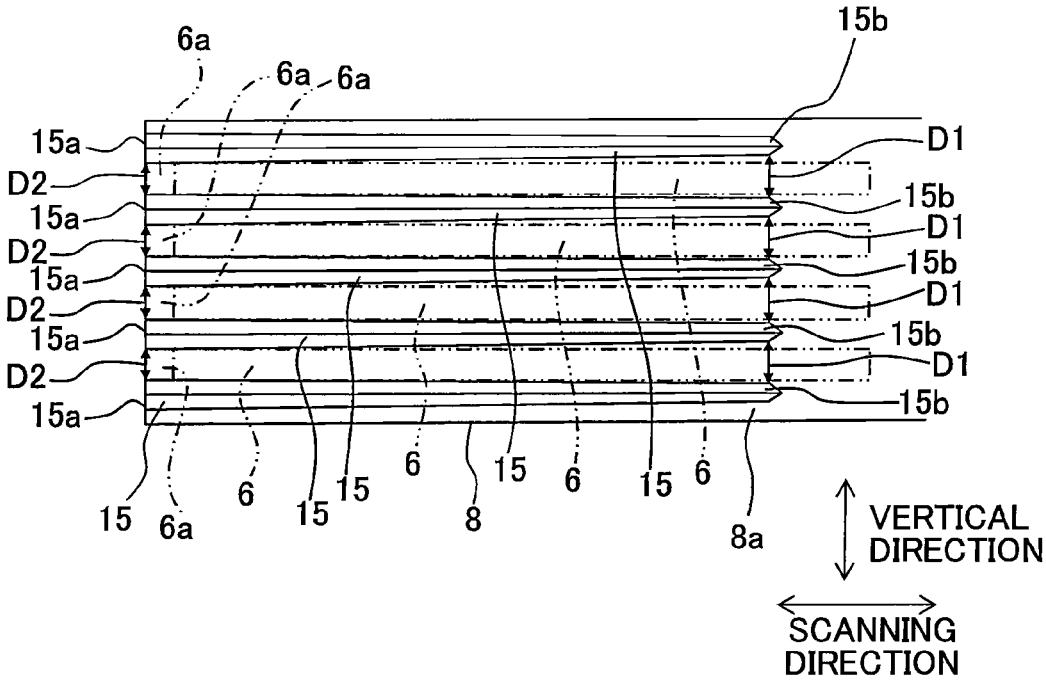
FIG. 5 is a diagram when

Moreover, the five ribs 15, as shown in FIG. 5, extend in the scanning direction, from a first end portion 15*a* which is near the fixed portion 6*a* of the tube 6 up to a second end portion 15*b*. Width of each of the five ribs 15 in the vertical direction decreases gradually in the direction away from the fixed portions 6*a* of the tubes 6 with respect to the scanning direction, in the entire area of the tube guide 8. In other words, the width of each of the ribs 15 in the vertical direction is decreased from the first end portion 15*a* of the ribs 15 toward the second end portion 15*b* opposite to the first end portion 15*a* in the scanning direction. Therefore, for the five ribs 15, a distance D1 between two of adjacent second end portions 15*b* is longer than a distance D2 between two of adjacent the first end portions 15*a*. Further, in the vicinity of the second end portion 15*b* of each of the five ribs 15, a proportion of a change in width in the vertical direction with respect to a change in the scanning direction is greater than that of another portion different from the portion in the vicinity of the second end portion 15*b*. Accordingly, at the portion in the vicinity of the second end portion 15*b*, a proportion of change in the distance D1 of the adjacent ribs 15 with respect to the change in the scanning direction is greater than that of another portion different from the portion in the vicinity of the second end portion 15*b*.

In the embodiment, since the tubes 6 are bent at portions between the abovementioned connecting ports 3*c* and the fixed portions 6*a*, the reaction forces F1 to F4 which intend to restore the tubes 6 from bent state to the original state are generated in the tubes 6. Moreover, in the embodiment, as the connecting ports 3*c* of the ink-jet head 3 to which one ends of the tubes 6 are connected and the fixed portions 6*a* of the tubes 6 are at different heights, the abovementioned reaction forces F1 to F4 act not only in a direction parallel to the horizontal plane (at least one of the scanning direction and the paper feeding direction), but also in the vertical direction.

Moreover, in the printer 1 which carries out printing by jetting the ink from the nozzles 10 of the ink-jet head 3, for instance, when an attempt is made to realize printing on a large recording paper P, it is necessary to increase an amount of ink to be supplied to the ink-jet head 3. Accordingly, it is necessary to increase a diameter of each of the tubes 6.

When the diameter of each of the tubes 6 is increased, the abovementioned reaction forces F1 to F4 are also increased, and there is a possibility that the tubes 6 are floated.

However, in the embodiment, since the ribs 15 are formed on the facing surface 8*a* of the tube guide 8 with which the tubes 6 contact, it is possible to regulate the tubes 6 from being floated, by the tubes 6 making a contact with the ribs 15.

Figure 4:
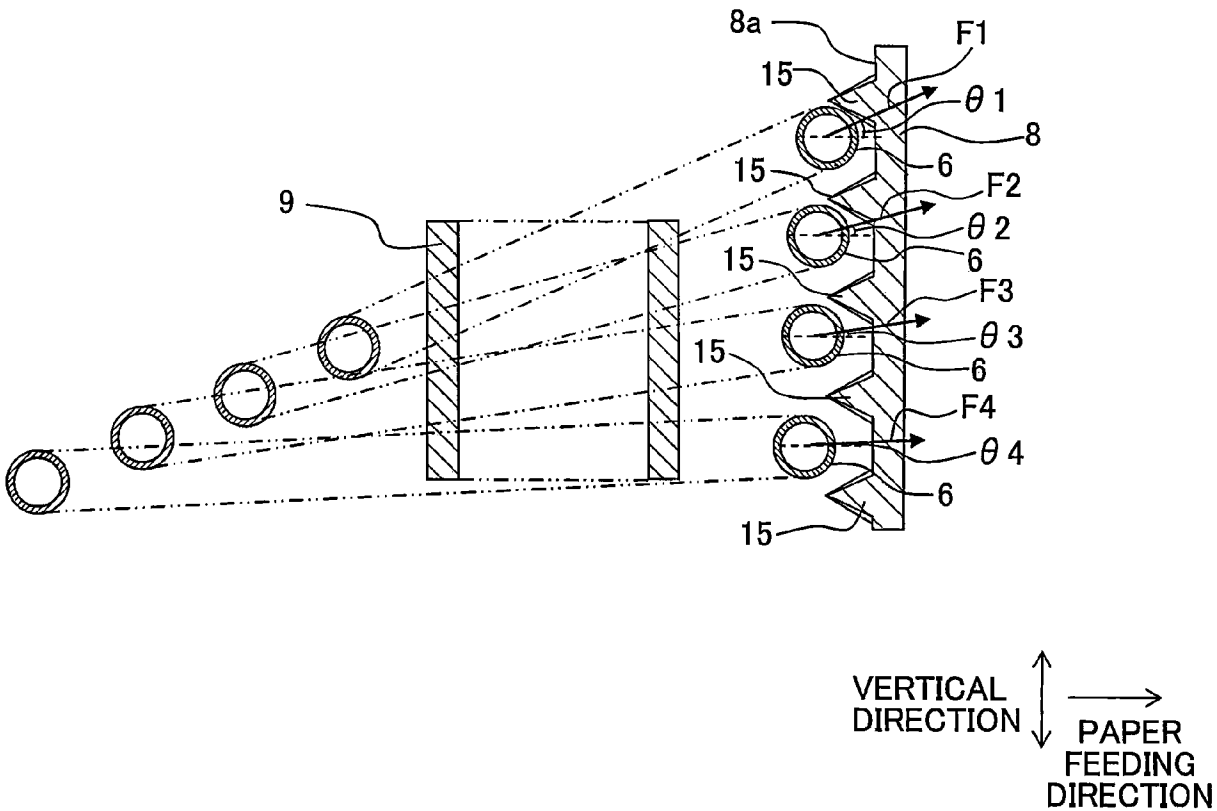
FIG. 4 is a cross-sectional view taken along a line IV-IV in FIG. 2.

At this time, unlike in the embodiment, even when only the rib 15 positioned at the uppermost position out of the five ribs 15 is provided, it is possible to prevent the abovementioned floating of the tubes 6. However, in this case, the four tubes 6 are not fixed mutually at the portions between the connecting ports 3*c* and the fixed portions 6*a*, and can be deformed independently, and the reaction forces F1 to F4 generated in the tubes 6 have different magnitude of angles θ1 to θ4 acting in the vertical direction as shown in FIG. 4, and magnitudes of a component in vertical direction of the reaction forces F1 to F4 are different. Therefore, an amount by which the four tubes 6 are floated varies mutually, and as a result, there is a possibility that the tubes 6 get entangled.

Whereas, in the embodiment, since the ribs 15 are provided individually corresponding to each of the four tubes 6, the four tubes 6 make a contact with the corresponding ribs 15, and accordingly, it is possible to prevent the floating of the tubes 6, and the entangling of the tubes 6.

In the embodiment, each of the ribs 15 has a tapered shape such that the width in the vertical direction is decreased in the direction away from the facing surface 8*a*. Accordingly, a distance between the ribs 15 may be greater than the diameter of each of the tubes 6 at least in the vicinity of front-end portions which are farthest from the facing surface 8*a*. Further, a distance between the ribs 15 may be smaller than the diameter of the tube 6 in the vicinity of the facing surface 8*a*.

Therefore, it is possible to make the distance between the ribs 15 small, and to prevent an increase in a size of the tube guide 8.

Moreover, as it has been described above, when the ink-jet head 3 reciprocates in the scanning direction, lengths of the tubes 6 making contact with the facing surface 8*a* change. More elaborately, as the ink-jet head 3 comes to a left side in FIG. 1, the lengths of the portions of the tubes 6 making contact with the facing surface 8*a* are increased.

Moreover, when the ink-jet head 3 is at a position near a right end in FIG. 1, a length of a portion, of each of the tubes 6, which makes contact with the facing surface 8*a* and which is restricted from displacement is short. Accordingly, the length of a portion from a point at which the tube 6 has started to be apart from the facing surface 8*a* to the point at which the tube 6 is connected to the connecting port 3*c* of the ink-jet head 3 is long, this portion of the tube 6 is capable of being deformed comparatively freely, and a diameter of bending of the tube 6 is increased.

On the other hand, when the ink-jet head 3 comes to a position near a left end in FIG. 1, and a length of a portion, of each of the tubes 6, which makes contact with the facing surface 8*a* becomes longer, the deformation of the tube 6 is restricted substantially by the tube guide 8. As a result, a length of a portion of the tube 6, from a point at which the tube 6 has started to be apart from the facing surface 8*a* to the point at which the tube 6 is connected to the connecting port 3*c*, is decreased and the diameter of bending of the tube 6 is increased. Moreover, when the diameters of bending of the tubes 6 are decreased, the magnitude of each of the reaction forces F1 to F4 is increased.

At this time, when the distance between the ribs 15 is small, the tube 6 between the ribs 15 is not capable of moving freely in the vertical direction, and as a result a substantial stress is generated in the tube 6. Moreover, when such substantial stress is generated in the tube 6, the tube 6 is caught in the rib 15 by being pressed against the rib 15 due to the stress. As a result, when the ink-jet head 3 moves, the tubes 6 are not capable of following the movement of the ink-jet head 3 smoothly, and there is a possibility that a smooth movement of the ink-jet head 3 is hindered.

Moreover, as it has been described above, four tubes 6 have the fixed portions 6*a* and one ends connected to the connecting ports 3*c* of the ink-jet head 3 at different heights, and are in a state of being twisted. Therefore, a direction of the reaction forces F1 to F4 generated in the tubes 6 act not only in the direction parallel to the horizontal plane but also in the vertical direction as it has been described above, and the tubes 6 are susceptible to be pressed against the rib 15, and furthermore are susceptible to be caught in the ribs 15.

However, in the embodiment, since the distance between two of the ribs 15 is increased with moving away substantially from the fixed portion 6*a* in the scanning direction, in the entire area of ribs 15, even when substantial reaction forces are generated in the tubes 6, the tubes 6 are capable of moving comparatively freely between the ribs 15. Therefore, the abovementioned stresses are reduced. As a result, the tubes 6 are hardly caught in the ribs 15, and it is possible to move the ink-jet head 3 smoothly.

Moreover, when the ink jet head 3 has moved to the extreme left side in FIG. 1, and has been positioned at a position farthest from the fixed portion 6*a* in the scanning direction, the diameter of bending of the tubes 6 become the smallest. However, at an end portion of the rib 15 on an opposite side of the fixed portion 6*a* with respect to the scanning direction, the proportion of the change in the distance D1 between the ribs 15 with respect to the change in the scanning direction is greater than that at other portion different from the end portion of the rib 15. Therefore, even when the ink-jet head 3 moves to the extreme left side in FIG. 1, it is possible to move the tubes 6 comparatively freely between the ribs 15, and the reaction forces of the tubes 6 are reduced sufficiently.

On the other hand, when the ink-jet head 3 moves to the right side in FIG. 1, and comes near the fixed portion 6*a* in the scanning direction, the diameter of bending of the tube 6 becomes large, and the reaction forces generated in the tubes 6 are decreased. Therefore, by decreasing the distance D1 between the adjacent ribs 15 sandwiching the tube 6 therebetween in a direction closer to the fixed portion 6*a* with respect to the scanning direction, it is possible to suppress the movement of the tube 6 between the adjacent ribs 15, and to prevent effectively the floating of the tube 6.

The FFC 9 is for applying a driving electric potential etc. to the ink-jet head 3, is arranged to be adjacent to the tube 6, on a side of the inner circumference of the bent tubes 6 in a plan view, and extends in a state of being bent along the tubes 6.

According to the embodiment described above, the distance D1 between the adjacent ribs 15 is increased in the direction away from the fixed portion 6*a* of the tube 6 with respect to the scanning direction, in the entire area of the tube guide 8. Accordingly, when the diameter of bending of the tubes 6 has been decreased due to the movement of the ink jet head 3 to the left side in FIG. 1, the tubes 6 are capable of moving comparatively freely between the ribs 15, and the stresses generated in the tubes 6 are reduced. As a result, the tubes 6 are hardly caught in the ribs 15, and it is possible to prevent the smooth movement of the ink-jet head 3 from being hindered.

Moreover, in the embodiment, the four tubes 6 are in the state of being twisted, and the reaction forces F1 to F4 which intend to restore the tubes 6 from the bent state to the original state act not only in the direction parallel to the horizontal plane but also in the vertical direction, and the tubes 6 are pressed against the ribs 15 assuredly. Therefore, the tubes 6 are susceptible to be caught in the ribs 15. However, in such a case, the distance D1 between the adjacent ribs 15 is increased in the direction away from the fixed portions 6*a* of the tubes 6 with respect to the scanning direction, in the entire area of the tube guide 8. Accordingly, the tubes 6 are capable of moving comparatively freely between the ribs 15, and the stress generated in each of the tubes 6 is reduced.

On the other hand, as the ink-jet head 3 moves to the right side in FIG. 1, and comes closer to the fixed portions 6*a* in the scanning direction, the diameter of bending of each of the tubes 6*a* is increased, and the reaction forces generated in the tubes 6 are decreased. Therefore, by decreasing the distance D1 between the adjacent ribs 15 sandwiching the tube 6 therebetween in a direction closer to the fixed portion 6*a* with respect to the scanning direction, it is possible to suppress the movement of the tubes 6 between the adjacent ribs 15, and to prevent effectively the floating of the tubes 6.

Next, modified embodiments in which various modifications are made in the embodiment will be described below. However, same reference numerals are assigned to components having a similar structure as in the embodiment, and the description of such components is omitted.

Figure 6:
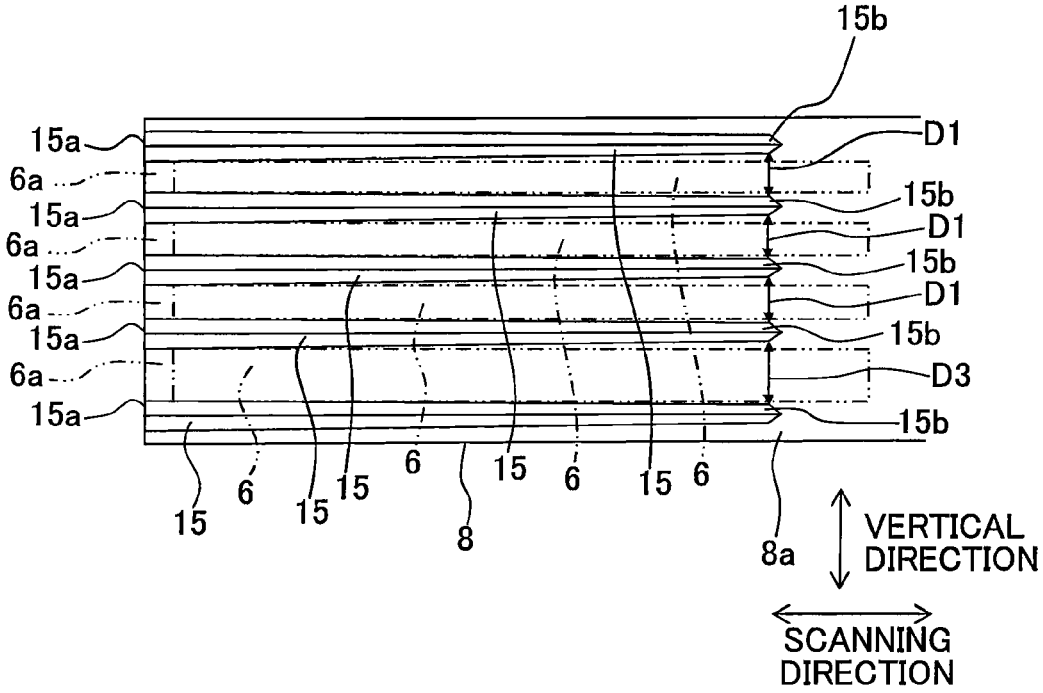
FIG. 6 is a diagram corresponding to FIG. 5, of a first modified embodiment.

In a first modified embodiment, as shown in FIG. 6, out of the tubes 6, the tube 6 at the lowest position is a tube for supplying the black ink, and the other three tubes 6 are the tubes 6 for supplying the color inks (yellow, cyan, and magenta). Moreover, since a frequency of use of the black ink being higher as compared to the color inks, out of the four tubes 6, the tube 6 at the lowest position is thicker than the other three tubes 6. Accordingly, a distance D3 between the ribs 15 sandwiching the tube 6 at the lowest position is greater than the distance D1 between adjacent ribs 15 sandwiching the other tubes 6 at the same position in the scanning direction (first modified embodiment).

As the tube 6 becomes thicker, the magnitude of the reaction forces which intend to restore the tubes 6 from the bent state to the original state are increased. However, since the distance D3 between the ribs 15 sandwiching the thick tube 6 is greater than the distance D1 between the adjacent ribs 15 sandwiching the other tubes 6 at the same position in the scanning direction, it is possible to reduce assuredly the stresses in the tubes 6.

On the other hand, as the ink-jet head 3 moves to the right side in FIG. 1 and comes closer to the fixed portions 6*a* in the scanning direction, the diameter of the bent tubes 6 is increased, and the reaction forces generated in the tubes 6 are decreased. Therefore, by decreasing the distances D1 and D3 between the adjacent ribs 15 sandwiching the tubes 6 respectively toward the fixed portion 6*a* in the scanning direction, it is possible to suppress the movement of the adjacent tubes 6 between the ribs 15, and to prevent effectively the floating of the tubes 6.

In the first modified embodiment, out of the four tubes 6, the tube 6 at the lowest position is thicker than the other tubes 6. However, not only the tube 6 at the lowest position but also any of the tubes 6 may be thicker than the other tubes 6.

Furthermore, all the four tubes 6 are not restricted to have the same thickness as in the embodiment described above, or one tube 6 is not restricted to be thicker than the other tubes 6 as in the first modified embodiment. The four tubes 6 may have mutually different thickness, and a distance between the ribs 15 at the same position in the scanning direction may be directly proportional to the thickness of the corresponding tube 6.

Figure 7:
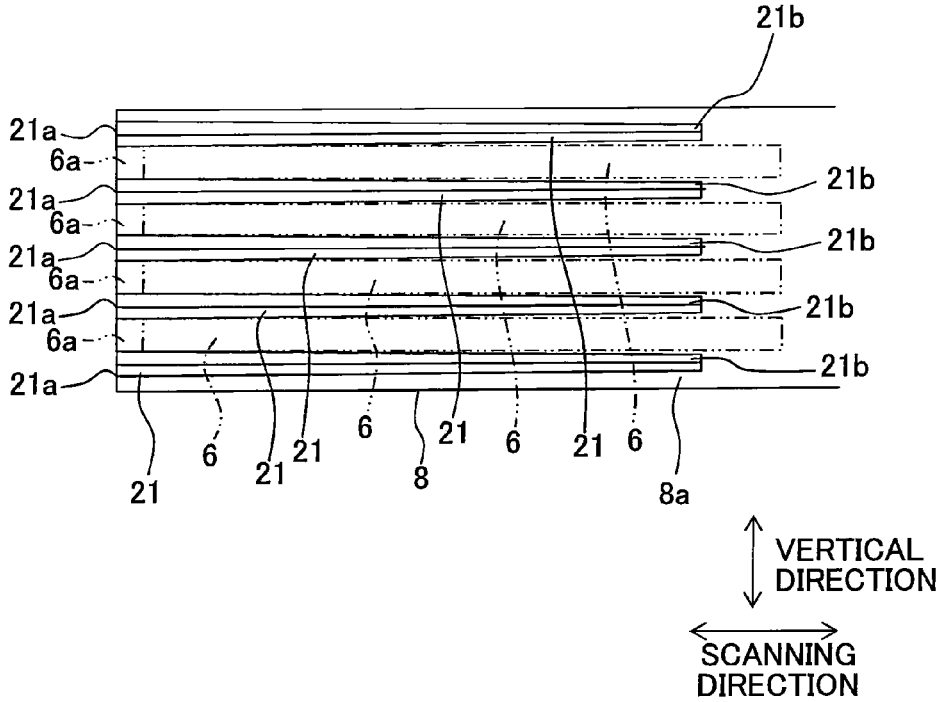
FIG. 7 is a diagram corresponding to FIG. 5, of a second modified embodiment.

In another modified embodiment, as shown in FIG. 7, five ribs 21 have widths in the vertical direction are decreased in the direction away from the fixed portions 6*a* with respect to the scanning direction, in the entire area of the tube guide 8, similarly as in the embodiment. In other words, each of the ribs 21 has a width in the vertical direction decreasing gradually, from a first end portion 21*a* to a second end portion 21*b*. Therefore, in the five ribs 21, distances between the adjacent ribs 21 are increased, from the first end portion 21*a* to the second end portion 21*b*. Moreover, a proportion of a change in a width of each of the ribs 21 in the vertical direction with respect to a change in the scanning direction is constant in the entire area (of the rib 21). Accordingly, a proportion of a change in the distance between the adjacent ribs 21 in the vertical direction with respect to a change of distance in the scanning direction is constant in the entire area of the tube guide 8 (second modified embodiment).

Even in this case, when the stresses as mentioned above are generated in the tubes 6, the abovementioned stresses are reduced by the tubes 6 moving freely between the ribs 21, and the tubes 6 are hardly caught in the ribs 21. As a result, it is possible to move the ink-jet head 3 smoothly.

On the other hand, when the ink-jet head 3 moves to the right side in FIG. 1 and comes closer to the fixed portions 6*a* in the scanning direction, the diameters of bent tubes 6 are increased, and the reaction forces generated in the tubes 6 are decreased. Therefore, by decreasing the distance between the adjacent ribs 21 sandwiching the tube 6 therebetween in a direction closer to the fixed portion 6*a* with respect to the scanning direction, it is possible to suppress the movement of the tube 6 between the adjacent ribs 21, and to prevent effectively the floating of the tubes 6.

Figure 8:
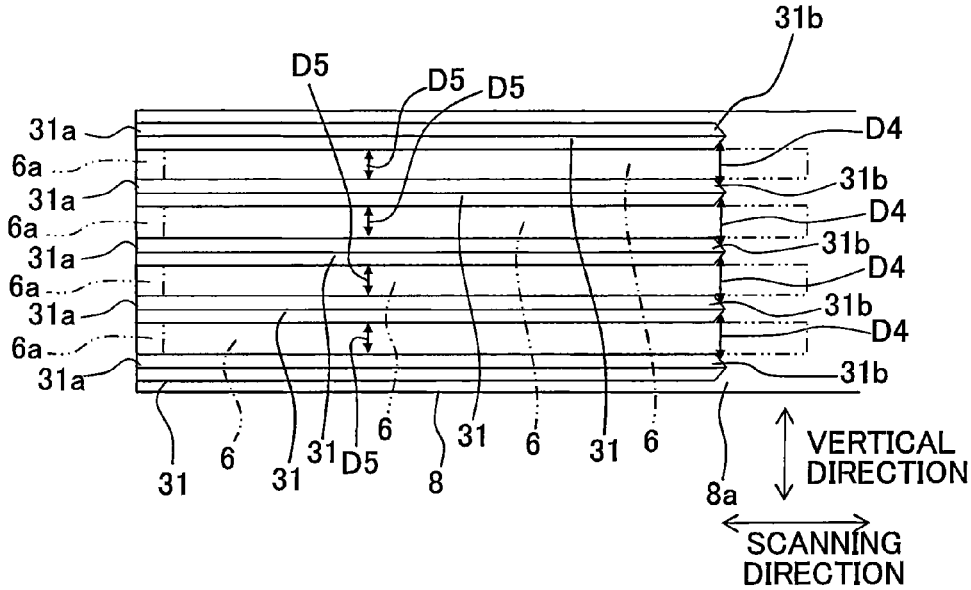
FIG. 8 is a diagram corresponding to FIG. 5, of a third modified embodiment.

In still another modified embodiment, as shown in FIG. 8, only in the vicinity of end portions at a right side in FIG. 8 of ribs 31, in other words, only in the vicinity of second end portions 31*b* (the other end portions on an opposite side of one end portions in the vicinity of the fixed portions 6*a*, distances D4 between the adjacent ribs 31 are increased in the direction away from the first end portions 31*a* with respect to the scanning direction. Moreover, distances D5 between the adjacent ribs 31 are almost constant at portions different from the portions near the second end portions 31*b* (Third modified embodiment).

The reaction forces generated in the tubes 6, as it has been described above, are particularly increased when the ink-jet head 3 has come to a position near the end on a left side in FIG. 1. At this time, out of the portions facing the facing surface 8*a* of the tubes 6, the reaction forces which intend to restore the tubes 6 from the bent state to the original state are maximum at the most acutely bent portions, or in other words, the portions which are farthest from the fixed portion 6*a* with respect to the scanning direction. Therefore, even when the distance D4 between the adjacent ribs 31 are increased in the direction away from the first end portion 31*a* with respect to the scanning direction only at the second end portions 31*b* (right-end portion in FIG. 8) of the ribs 31, the portions of the tubes 6 at which the reaction forces are increased are capable of moving comparatively freely between the second end portions 31*b* of the adjacent ribs 31, and it is possible to reduce the stresses generated in the tubes 6.

On the other hand, when the ink-jet head 3 moves to the right side in FIG. 1 and comes closer to the fixed portions 6*a* in the scanning direction, the diameters of bending of the tubes 6 are increased and the reaction forces generated in the tubes 6 are decreased. Therefore, by making the distance D5 between the adjacent ribs 31 sandwiching the tube 6 being small at the portions different from the second end portions 31*b*, it is possible to suppress the movement of the tubes 6 between the adjacent ribs 31, and to prevent effectively the floating of the tubes 6.

Figure 9:
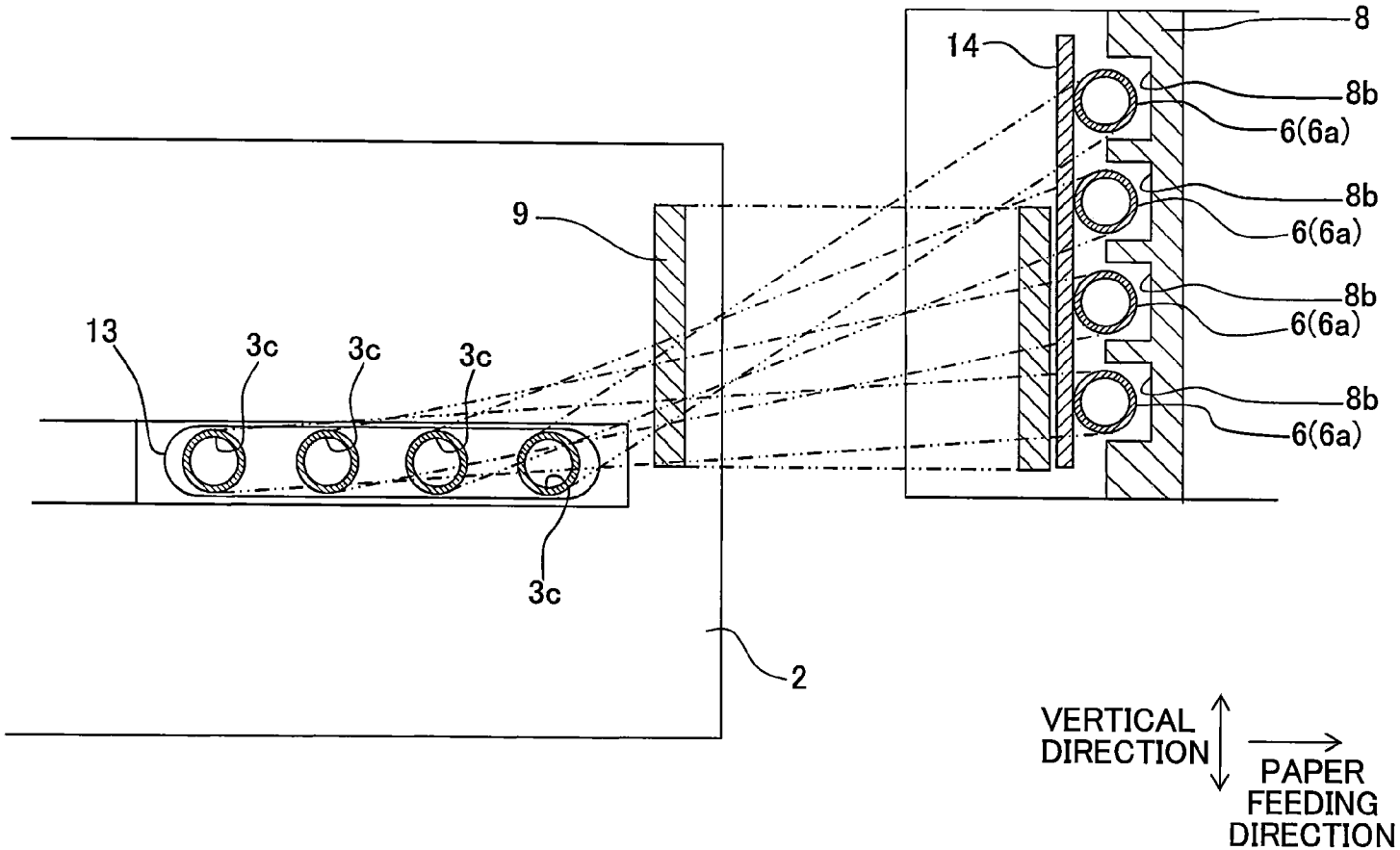
FIG. 9 is a diagram corresponding to FIG. 3, of a fourth modified embodiment.
Figure 10:
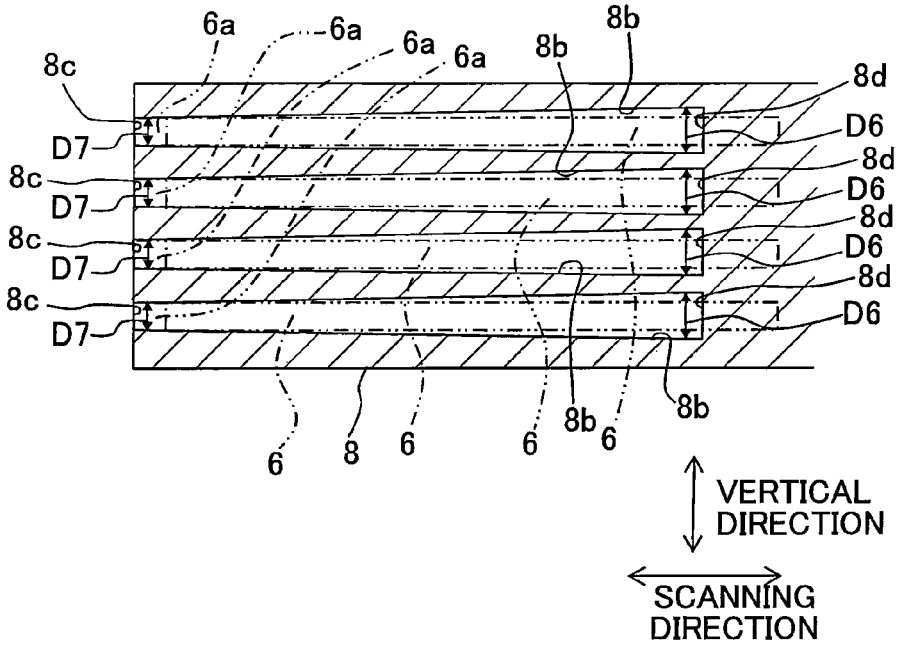
FIG. 10 is a diagram corresponding to FIG. 5, of the fourth modified embodiment.

Moreover, in the embodiment, the plurality of accommodating portions have been defined by the facing surface 8*a* of the tube guide 8 and the plurality of ribs 15 projected from the facing surface 8*a*. However, as shown in FIG. 9 and FIG. 10, there may be a plurality of grooves 8*b* (corresponding to recess or recesses of claims) which are formed in the tube guide 8. As shown in FIG. 10, these grooves 8*b* extend in the scanning direction, from first end portions 8*c* in which the fixed portions 6*a* of the tubes 6 are accommodated, up to second end portions 8*d* on an opposite side of the first end portions 8*c*, respectively. Moreover, a width in the vertical direction of each of the grooves 8*b* is gradually increased from the first end portion 8*c* toward the second end portion 8*d*. In other words, a width D6 in the vertical direction at the second end portion 8*d* is greater than a width D7 in the vertical direction at the first end portion 8*c* (fourth modified embodiment).

Even in the fourth modified embodiment, the width in the vertical direction of each of the grooves 8*b* is gradually increased in the direction away from the first end portion 8*c*. Therefore, even when a substantial reaction force is generated in the tube 6 at a position away from the fixed portion 6*a* of the tube 6, the tube 6 is capable of moving comparatively freely inside the groove 8*b*. As a result, the abovementioned stress is reduced, and the tube 6 is hardly caught in the groove 8*b*. Accordingly, it is possible to move the ink jet head 3 smoothly.

In the fourth modified embodiment, the width in the vertical direction of each of the grooves 8*b* may be gradually increased in the direction away from the first end portion 8*c* only in the vicinity of the second end portions 8*d* of the grooves 8*b*, and at portions different from the portion near the second end portion 8*d*, the width in the vertical direction of each of the grooves 8*b* may be constant. Even in this case, it is possible to achieve a similar effect as in the third modified embodiment.

Moreover, in the embodiment, out of the five ribs 15, the three ribs 15 except for the two ribs 15 arranged at the upper end and lower end serve as one of the two ribs forming the pair of ribs sandwiching the tube 6 positioned above these ribs 15, and as one of the ribs forming the pair of ribs sandwiching the tube 6 positioned below these ribs 15. However, ribs forming the pair of ribs corresponding to the four tubes 6 respectively may be provided separately. In this case, two ribs are arranged between the adjacent two tubes 6 among the four tubes 6, respectively.

Moreover, in the embodiment, the four tubes 6 arranged in the vertical direction at the fixed portions 6*a* are connected in order from the tubes 6 positioned at the upper side, to the connecting ports 3*c* in order from the connecting port 3*c* positioned at the lower side in FIG. 1 (inner peripheral side of bending of the tubes 6 in a plan view), and the four tubes 6 are twisted. However, conversely, the four tubes 6 may be connected in order from the tube 6 positioned at the upper side, to the connecting ports 3*c* in order from the connecting port 3*c* positioned at the upper side in FIG. 1 (outer peripheral side of bending of the tube 6 in a plan view), and the four tubes 6 may be twisted.

Positions and arrangement direction of the four tubes 6 at the fixed portions 6*a* and connecting portions to the ink-jet head 3 are not restricted to the positions and the arrangement direction described above, and moreover, the four tubes 6 may not be in the state of being twisted.

In the embodiment, there are four tubes 6. However, the number of tubes may be three or less than three, or five or more than five.

In the abovementioned description, an example, in which the present invention is applied to a printer which carries out printing on the recording paper P by jetting the ink from the ink-jet head 3 moving in the scanning direction together with the carriage 2, has been cited. However, the present invention is also applicable to a liquid jetting apparatus which jets a liquid other than ink from the nozzles, while moving in the scanning direction.

What is claimed is:

1. A liquid jetting apparatus which jets a liquid, comprising:

a liquid jetting head which reciprocates in a first direction on a predetermined plane and which jets the liquid from a nozzle;

a liquid supply source which stores the liquid to supply to the liquid jetting head;

a flexible tube which constructs a part of a liquid flow passage from the liquid supply source to the liquid jetting head, and which is fixed to the liquid jetting apparatus at a predetermined fixed portion which is different from a connecting portion of the tube at which the tube is connected to the liquid jetting head, and which is arranged in a state that the tube is bent at a portion between the fixed portion and the connecting portion; and a regulating member which is arranged on a side of outer circumference of the tube in the state of being bent when viewed from a second direction orthogonal to the predetermined plane, which regulates a movement of the tube caused by bending of the tube, and which has an accommodating portion extending in the first direction and accommodating the tube;

wherein the accommodating portion has a first end portion at which the fixed portion of the tube is accommodated and a second end portion which is opposite to the first end portion in the first direction; and wherein, at a portion of the accommodating portion in the vicinity of the second end portion, a width of the accommodating portion, in the second direction, is increased toward the second end portion in the first direction.

2. The liquid jetting apparatus according to claim 1;

wherein the accommodating portion is defined by a facing surface and a pair of ribs;

wherein the facing surface extending in the first and second direction, facing an extending portion of the tube extending in the first direction from the fixed portion to the connecting portion, and regulating movement of the extending portion of the tube on the predetermined plane in a direction orthogonal to the first direction;

wherein the pair of ribs being formed on the faring surface to extend in the first direction and to sandwich the tube in the second direction; and wherein, at a portion of the accommodating portion in the vicinity of the second end portion, a distance between the ribs is increased toward the second end portion in the first direction.

3. The liquid jetting apparatus according to claim 1, further comprising a fixing member which fixes the fixed portion of the tube to the liquid jetting apparatus.

4. The liquid jetting apparatus according to claim 1;

wherein the fixed portion is formed in the tube at an intermediate portion thereof.

5. The liquid jetting apparatus according to claim 3;

wherein the fixed portion is fixed to the regulating member by the fixing member.

6. The liquid jetting apparatus according to claim 2;

wherein each of the ribs has a tapered shape of which width in the second direction is decreased in a direction away from the facing surface.

7. The liquid jetting apparatus according to claim 2;

wherein in an entire area of the regulating member, the distance between the ribs is increased toward the second end portion in the first direction.

8. The liquid jetting apparatus according to claim 7;

wherein, at the portion of the accommodating portion in the vicinity of the second end portion, rate of change of the distance between the ribs with respect to change of a distance from the first end portion in the first direction is greater than that at portions of the accommodating portion different from the portion in the vicinity of the second end portion.

9. The liquid jetting apparatus according to claim 2;

wherein the tube is formed as a plurality of tubes having fixed portions respectively, and the pair of ribs is formed as a plurality of pairs of ribs corresponding to the tubes respectively; and wherein the pairs of ribs are arranged to sandwich the tubes in the second direction, respectively.

10. The liquid jetting apparatus according to claim 9;

wherein the tubes have same lengths.

11. The liquid jetting apparatus according to claim 10;

wherein each of the tubes extends in the first direction from the fixed portion, and is bent back in a U-shape at an intermediate portion thereof.

12. The liquid jetting apparatus according to claim 9;

wherein the liquid jetting head has a plurality of connecting ports to which the tubes are connected, and which are arranged in a row in a third direction along the predetermined plane;

wherein the fixed portions of the tubes are located at positions different from positions of the connecting ports in relation to a direction parallel to the predetermined plane and orthogonal to the first direction; and wherein the fixed portions are arranged in a row in the second direction.

13. The liquid jetting apparatus according to claim 9;

wherein the tubes include a first tube and a second tube which is thicker than the first tube; and wherein the pairs of the ribs include a first pair of the ribs between which the first tube is sandwiched and a second pair of the ribs between which the second tube is sandwiched, and at any position in the first direction, a distance between the ribs of the first pair of the ribs is greater than a distance between the ribs of the second pair of the ribs.

14. The liquid jetting apparatus according to claim 1;

wherein the accommodating portion is a recess formed in the regulating member.

15. The liquid jetting apparatus according to claim 14;

wherein the tube is formed as a plurality of tubes, and the recess is formed as a plurality of recesses which accommodate the tubes respectively.

16. The liquid jetting apparatus according to claim 15;

wherein the tubes have same lengths.

17. The liquid jetting apparatus according to claim 16;

wherein each of the tubes extends in the first direction from the fixed portion, and is bent back in a U-shape at an intermediate portion thereof.

* * * * *